US007953344B2

(12) United States Patent
Ishida

(10) Patent No.: US 7,953,344 B2
(45) Date of Patent: May 31, 2011

(54) IMAGE FORMING APPARATUS AND IMAGE QUALITY MAINTAINING METHOD

(75) Inventor: Kazufumi Ishida, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 372 days.

(21) Appl. No.: 12/137,729

(22) Filed: Jun. 12, 2008

(65) Prior Publication Data

US 2009/0052920 A1 Feb. 26, 2009

Related U.S. Application Data

(60) Provisional application No. 60/957,327, filed on Aug. 22, 2007.

(51) Int. Cl.
*G03G 15/16* (2006.01)

(52) U.S. Cl. ..... 399/101

(58) Field of Classification Search ..... 399/21, 399/61, 101, 299, 302, 308, 66, 303, 346
See application file for complete search history.

(56) References Cited

U.S. PATENT DOCUMENTS 5,253,022 A * 10/1993 Takeuchi et al. ..... 399/313
5,621,509 A * 4/1997 Karashima et al. ..... 399/46
5,857,132 A * 1/1999 Mizuishi et al. ..... 399/66
6,701,118 B2 * 3/2004 Kayahara et al. ..... 399/315
6,766,120 B2 * 7/2004 Yokoi ..... 399/21
7,162,179 B2 * 1/2007 Yoshida ..... 399/101
7,398,024 B2 * 7/2008 Ishihara ..... 399/21
7,542,713 B2 * 6/2009 Yoshida ..... 399/346
7,747,188 B2 * 6/2010 Ishida ..... 399/101
2009/0214253 A1 * 8/2009 Murao ..... 399/101

FOREIGN PATENT DOCUMENTS

JP 11-035185 2/1999
JP 2004-094055 3/2004
JP 2004094055 A * 3/2004
JP 2005181651 A * 7/2005

* cited by examiner

*Primary Examiner* — Robert Beatty
(74) *Attorney, Agent, or Firm* — Turocy & Watson, LLP

(57) ABSTRACT

A technique is provided that enables maintaining an appropriate level of image quality even under conditions that the quantity of residual toner increases in an image forming apparatus in which a lubricant is supplied to a cleaning target part from which a residual toner is removed by a cleaning member. In timing when a toner image carried on an image carrier reaches a predetermined transfer position, reaching failure information indicating that a sheet to which the toner image should be transferred does not reach the predetermined transfer position is acquired. In the case where the reaching failure information is acquired, an electric field that is opposite to an electric field generated when transferring the toner image on the image carrier to the sheet is generated between the image carrier and the transfer member.

12 Claims, 8 Drawing Sheets

IMAGE FORMING APPARATUS AND IMAGE QUALITY MAINTAINING METHOD

BACKGROUND OF THE INVENTION

1. Field of the Invention

The present invention relates to an image forming apparatus in which a lubricant is supplied to a cleaning target part from which a residual toner is removed by a cleaning member, and particularly to an image quality maintaining technique in such an image forming apparatus.

2. Description of the Related Art

A toner image formed on an image carrier in an image forming apparatus goes through a transfer process and ultimately shifts onto a recording medium (herein after referred to as a sheet). In this transfer process, all the toner may not perfectly shift. In such cases, a small amount of toner remains on the image carrier. In the case of an image forming apparatus employing an intermediate transfer system, the residual toner may adhere to a secondary transfer roller that has the function of pressing a sheet to an intermediate transfer member at a secondary transfer position.

In the image forming apparatus, the unwanted toner remaining on the image carrier and the member that contacts the image carrier (here referred to as a cleaning target part) must be collected. As means for collecting such residual toner, a technique of abutting the edge of a plate-like cleaning member (so-called cleaning blade) made of urethane rubber or the like to the moving direction of the moving surface of a cleaning target part by a counter (so-called "counter system") is known. Also, a different abutment method from the counter system, that is, a trail system, is known. The toner collected by the cleaning member abutted in accordance with one of the counter system and the trail system is collected into a housing section.

Supplying a lubricant on the cleaning target part is known as a technique to stabilize the cleaning performance of the cleaning member in the techniques of removing the residual toner on the cleaning target part by using such a cleaning member.

The lubricant not only can serve to prevent the plate-like cleaning member from lifting but also can serve to improve the separability of the toner and thus enhance the toner removal effect by the cleaning member. Moreover, as the lubricant is used, the mechanical frictional force between the cleaning member and the cleaning target part is reduced and therefore advantages can be expected such as prevention of local edge cracking in the cleaning member, reduction in the quantity of friction, and prevention of toner fixation due to reduction in the quantity of heat generation.

Meanwhile, in the case of adjusting the image density or in the case where a large quantity of toner is transferred to a sheet, if a sheet jam occurs, the large quantity of toner is directly transferred from the intermediate transfer member to the secondary transfer roller. However, the toner removing capability of the cleaning member has its limitation, and the toner that the cleaning member has failed to remove, of the large quantity of transferred toner, is carried downstream from the cleaning member in the moving direction of the cleaning target surface.

In an image forming apparatus in which the lubricant supply unit that supplies the lubricant as described above is arranged downstream from the cleaning member in the moving direction of the cleaning target surface, if the residual toner enters the downstream side from the cleaning member in the moving direction of the cleaning target surface as described above, the lubricant supply performance of the lubricant supply unit may be adversely affected.

Moreover, depending on the quantity of the residual toner that reaches the lubricant supply unit, part of the residual toner pass through the lubricant supply unit and may appear as noise on the image formed by the image forming apparatus.

SUMMARY OF THE INVENTION

An object of an embodiment of the invention is to provide a technique that enables maintaining the image quality at a proper level even under such conditions that the quantity of residual toner increases, in an image forming apparatus in which a lubricant is supplied to a cleaning target part from which a residual toner is removed by a cleaning member.

To solve the above problems, an image forming apparatus according to an aspect of the invention includes: an image carrier that holds and carries a toner image; a transfer member that nips and carries a sheet in cooperation with the image carrier at a predetermined transfer position and transfers the toner image carried on the image carrier onto the sheet; a cleaning member that is abutted to a transfer surface abutted to the sheet, of the transfer member, and removes the toner adhering to the transfer surface; a lubricant supply unit arranged downstream from the cleaning member and upstream from the predetermined transfer position in a moving direction of the transfer surface of the transfer member, and configured to supply a lubricant to the transfer surface of the transfer member; an information acquiring unit configured to acquire reaching failure information indicating that the sheet to which the toner image should be transferred does not reach the predetermined transfer position in timing when the toner image carried on the image carrier reaches the predetermined transfer position; and an electric field control unit configured to generate an electric field that is opposite to an electric field generated when transferring the toner image on the image carrier to the sheet, between the image carrier and the transfer member in the case where the reaching failure information is acquired by the information acquiring unit.

An image forming apparatus according to another aspect of the invention includes: an image carrier that holds and carries a toner image; a transfer member that nips and carries a sheet in cooperation with the image carrier at a predetermined transfer position and transfers the toner image carried on the image carrier onto the sheet; a cleaning member that is abutted to a transfer surface abutted to the sheet, of the transfer member, and removes the toner adhering to the transfer surface; a lubricant supply unit arranged downstream from the cleaning member and upstream from the predetermined transfer position in a moving direction of the transfer surface of the transfer member, and configured to supply a lubricant to the transfer surface of the transfer member; an information acquiring unit configured to acquire reaching failure information indicating that the sheet to which the toner image should be transferred does not reach the predetermined transfer position in timing when the toner image carried on the image carrier reaches the predetermined transfer position; and an electric field control unit configured to generate an electric field in a direction in which the toner shifts from the side of the lubricant supply unit to the side of the transfer member, in the case where the reaching failure information is acquired by the information acquiring unit.

An image quality maintaining method according to still another aspect of the invention is for an image forming apparatus including an image carrier that holds and carries a toner image, a transfer member that nips and carries a sheet in cooperation with the image carrier at a predetermined transfer position and transfers the toner image carried on the image carrier onto the sheet, a cleaning member that is abutted to a transfer surface abutted to the sheet, of the transfer member, and removes the toner adhering to the transfer surface, and a lubricant supply unit arranged downstream from the cleaning member and upstream from the predetermined transfer position in a moving direction of the transfer surface of the transfer member and configured to supply a lubricant to the transfer surface of the transfer member. The method includes: acquiring reaching failure information indicating that the sheet to which the toner image should be transferred does not reach the predetermined transfer position in timing when the toner image carried on the image carrier reaches the predetermined transfer position; and generating an electric field that is opposite to an electric field generated when transferring the toner image on the image carrier to the sheet, between the image carrier and the transfer member in the case where the reaching failure information is acquired.

DESCRIPTION OF THE EMBODIMENTS

Hereinafter, embodiments of the invention will be described with reference to the drawings.

Figure 1:
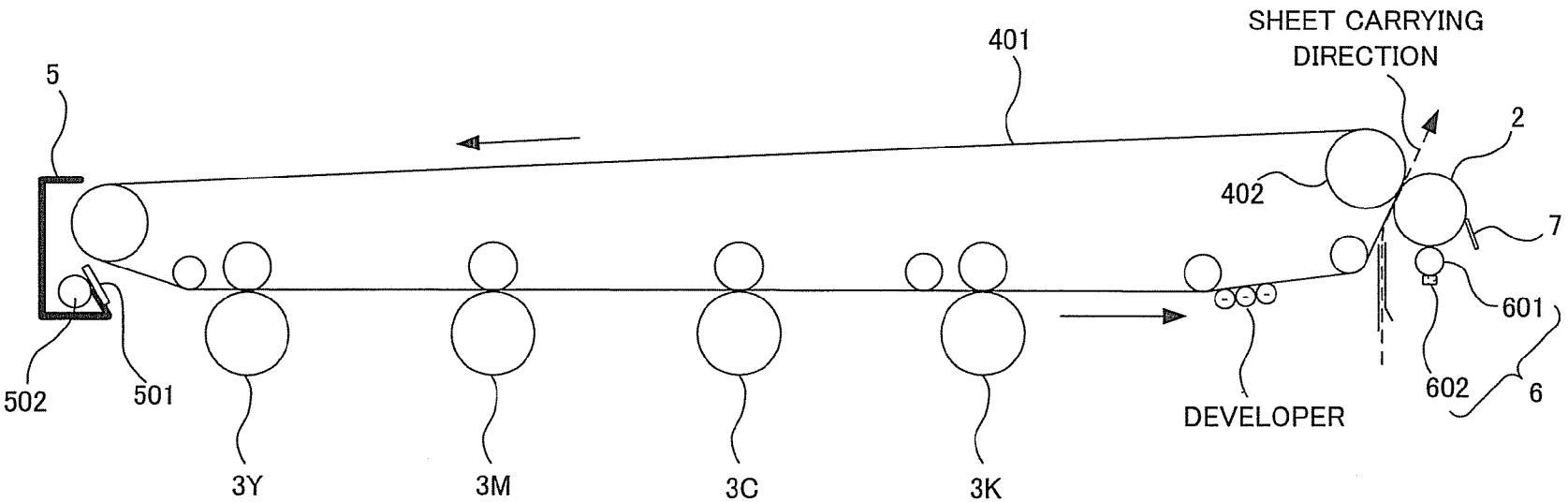
FIG. 1 is a view showing an exemplary configuration of an image forming apparatus according to an embodiment of the invention.
Figure 2:
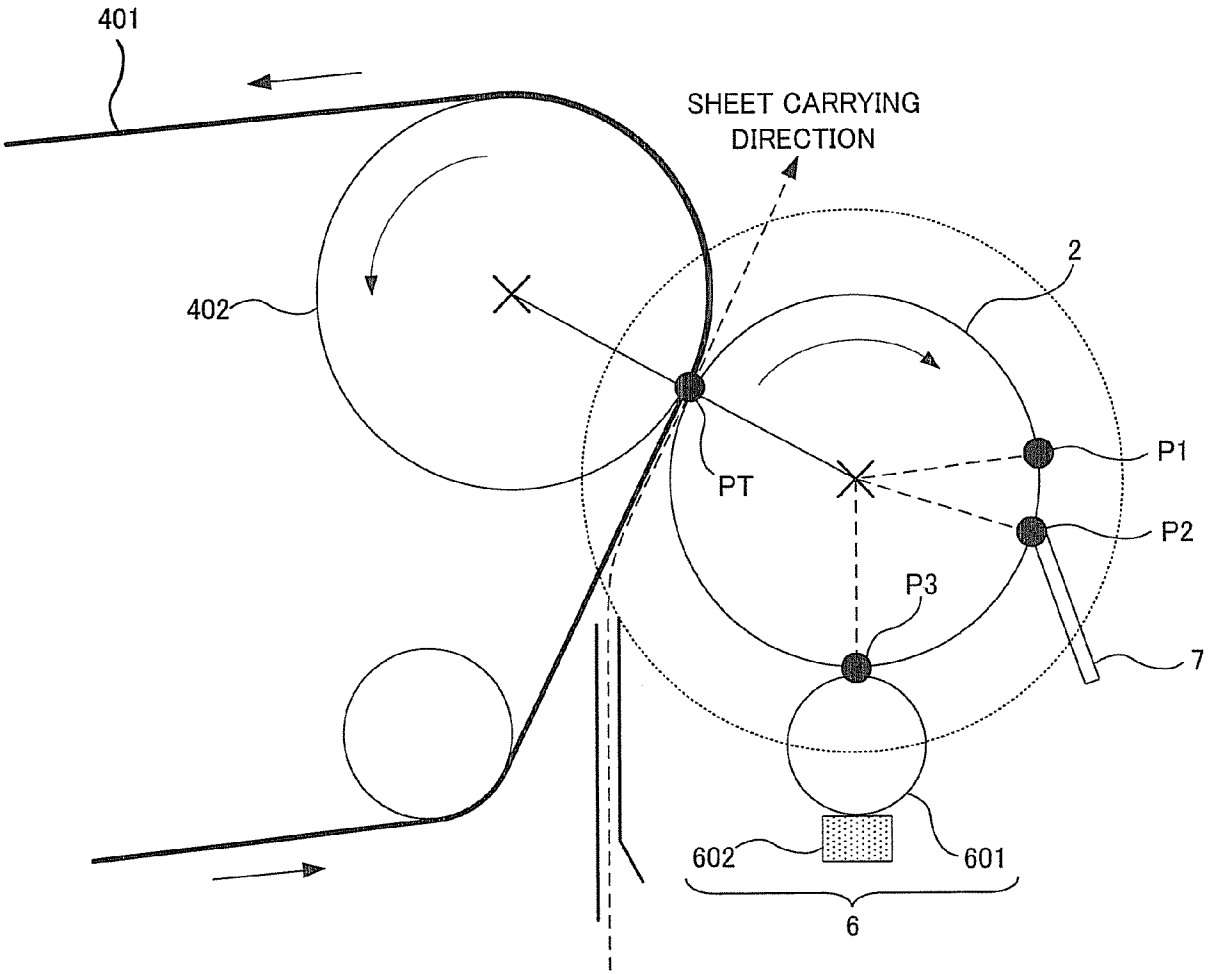
FIG. 2 is a view showing a configuration of the vicinity of a transfer roller in the image forming apparatus according to the embodiment of the invention.

FIG. 1 is a view showing an exemplary configuration of an image forming apparatus according to an embodiment of the invention. FIG. 2 is a view showing a configuration of the vicinity of a transfer roller in the image forming apparatus according to the embodiment of the invention.

As shown in FIG. 1 and FIG. 2, the image forming apparatus according to the embodiment of the invention employs a so-called "intermediate transfer system", in which toner images formed on photo conductive drums 3Y to 3K are superimposed and transferred onto an endless intermediate transfer belt 401 (equivalent to an image carrier) and then the toner images transferred onto the intermediate transfer belt 401 are transferred to a sheet at a predetermined transfer position PT.

Specifically, to transfer the toner images from the intermediate transfer belt 401 to the sheet, the intermediate transfer belt 401 and a transfer roller (transfer member) 2 cooperate to nip and carry the sheet at the predetermined transfer position PT, and the toner images carried on the intermediate transfer belt 401 are transferred onto the sheet.

As shown in FIG. 2, a cleaning member 7 for removing a residual toner adhering to the roller surface (transfer surface) of the transfer roller 2 is abutted to the roller surface.

The cleaning member 7 in this example is a cleaning blade made of, for example, urethane rubber or the like. The cleaning member 7 is abutted to the roller surface at an angle tilted toward the moving direction of the roller surface with respect to a normal line on the roller surface of the transfer roller 2 (counter system).

Moreover, a lubricant supply unit 6 that supplies a lubricant to the roller surface of the transfer roller 2 is arranged downstream from the cleaning member 7 and upstream from the predetermined transfer position PT in the moving direction of the roller surface of the transfer roller 2.

The lubricant supply unit 6 includes a lubricant application brush roller 601 and a solid lubricant 602.

The lubricant application brush roller 601 is set to rotate in a direction following the rotating direction of the transfer roller 2. The solid lubricant 602 is scraped off by the lubricant application brush roller 601 into micro particles on the lubricant application brush roller 601. The lubricant in the form of micro particles secured on the lubricant application brush roller 601 is applied to the roller surface of the transfer roller 2. It is preferable that the solid lubricant used here is metallic salts of fatty acid such as zinc stearate or stearic acid.

Figure 3:
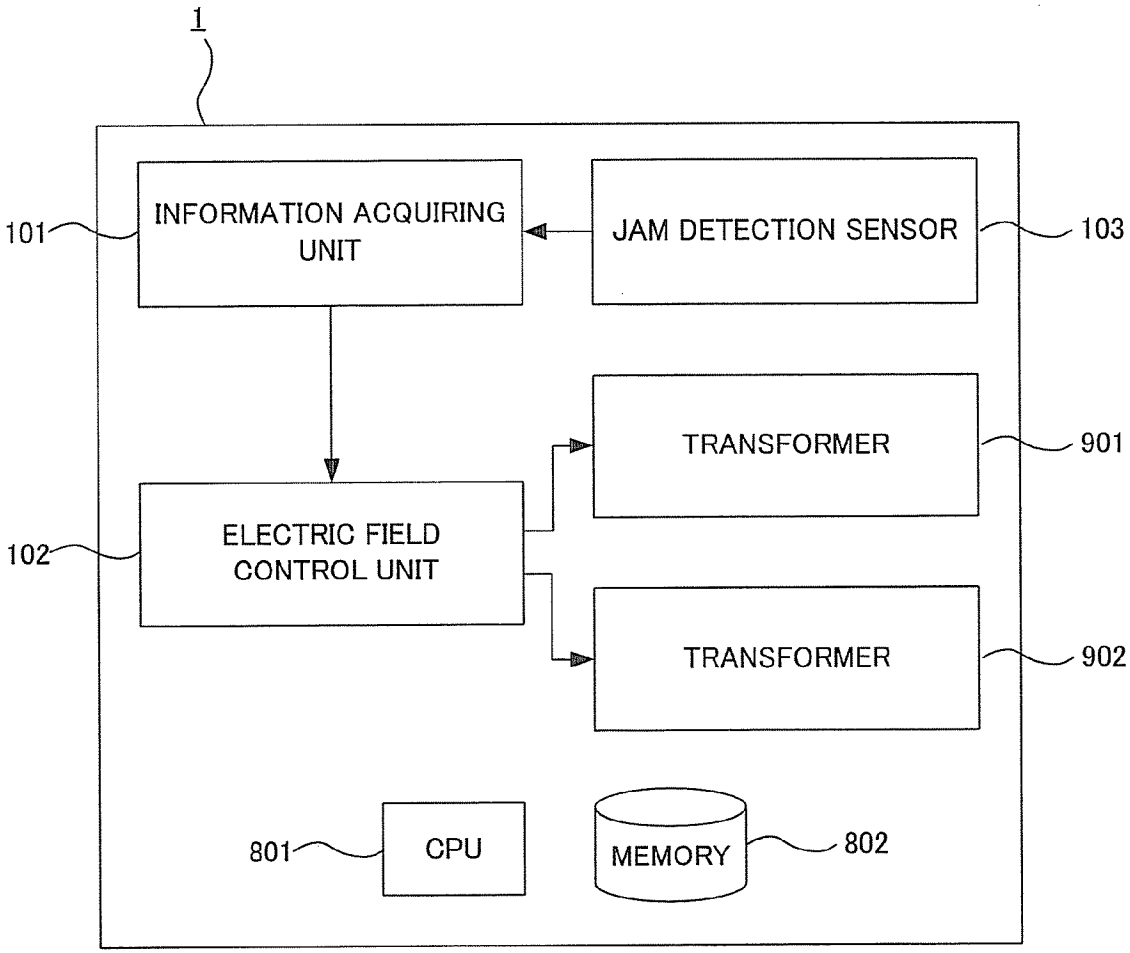
FIG. 3 is a functional block diagram for explaining the image forming apparatus according to the embodiment.

FIG. 3 is a functional block diagram for explaining the image forming apparatus according to the embodiment.

The image forming apparatus according to the embodiment has an information acquiring unit 101, an electric field control unit 102, a jam detection sensor 103, a transformer 901, a transformer 902, a CPU 801, and a memory 802.

The information acquiring unit 101 acquires reaching failure information (jam detection information and so on) indicating that the sheet to which the toner image should be transferred does not reach the predetermined transfer position PT in timing when the toner image carried on the intermediate transfer belt 401 reaches the predetermined transfer position PT, from the jam detection sensor 103 arranged in the image forming apparatus.

The electric field control unit 102 controls the transformer 901 to generate an electric field that is opposite to the electric field generated when transferring the toner image to the sheet, between the intermediate transfer belt 401 and the transfer roller 2 in the case where the reaching failure information is acquired by the information acquiring unit 101.

The electric field control unit 102 also controls the transformer 902 to generate an electric field in the direction in which the toner shifts from the side of the lubricant supply unit 6 to the side of the transfer roller 2 in the case where the reaching failure information is acquired by the information acquiring unit 101.

The CPU 801 is responsible for carrying out various processing in the image forming apparatus and is also responsible for realizing various functions by executing programs stored in the memory 802. The memory 802 is formed by, for example, a ROM or RAM, and is responsible for storing various information and programs used in the image forming apparatus.

Figure 4:
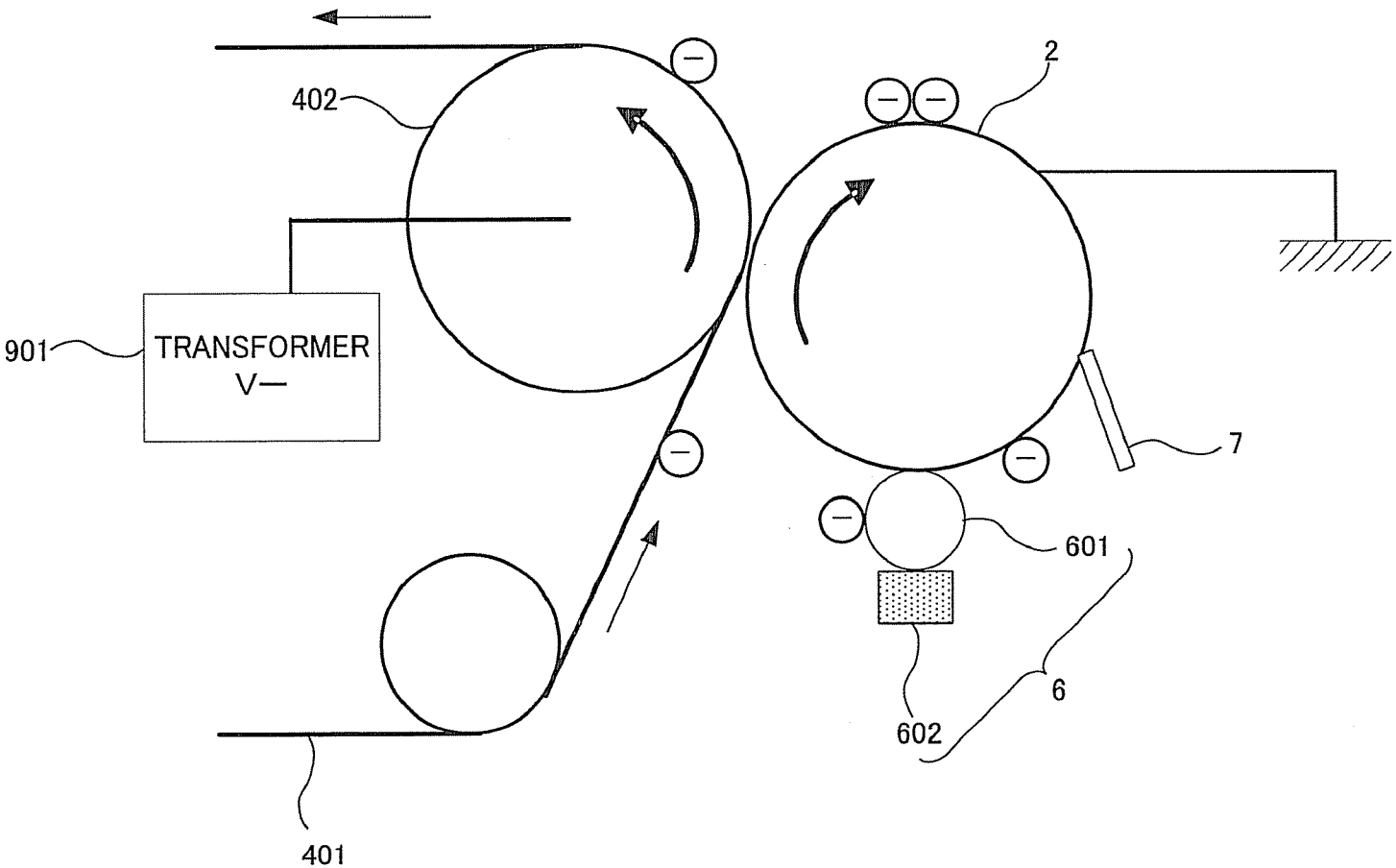
FIG. 4 is a view for explaining the state of the vicinity of a transfer roller 2 at the time of sheet jamming in the image forming apparatus according to the embodiment.

FIG. 4 is a view for explaining the state of the vicinity of the transfer roller 2 at the time of sheet jamming in the image forming apparatus according to the embodiment.

Here, in this example, a case is described where a toner charged with the transfer polarity, that is, a negatively charged toner, is adhering to the roller surface of the transfer roller 2.

Normally, in the state where no sheet jam has occurred, the toner on the intermediate transfer belt 401 is transferred to the sheet at the transfer position PT and therefore no shift of the toner to the transfer roller 2 occurs.

However, if the toner image is transferred onto the intermediate transfer belt 401 and a sheet jam occurs, the sheet does not reach the transfer position PT though the toner image transferred onto the intermediate transfer belt 401 reaches the transfer position PT. Therefore, the toner that should be transferred to the sheet shifts to the transfer roller 2.

In this case, all the toner on the intermediate transfer belt 401 does not totally shift to the transfer roller 2, but active toner shift to the transfer roller 2 actually occurs and a larger quantity of unwanted toner than normally expected reaches the cleaning member 7.

The transfer roller 2 in this embodiment is set to have a hardness of about 35 degrees, which is typically employed. As its hardness falls within the frequently used range of 28 to 40 degrees, the transfer roller 2 belongs to a category of elastic material.

The cleaning ability of the plate-like cleaning member 7 may be lowered by various factors including the deterioration due to wear, creep and so on of the cleaning member 7 itself, the deterioration of the transfer roller 2, and environmental conditions.

When cleaning failure by the cleaning member 7 occurs, that is, when the toner cannot be totally removed by the plate-like cleaning member 7 and has passed through the cleaning member 7, the toner will be supplied to the lubricant application brush roller 601 of the lubricant supply unit 6.

The residual toner thus carried to the lubricant supply unit 6 is accumulated in the lubricant application brush roller 601 and changes the state of scraping of the solid lubricant 602. Such influence of the residual toner on the lubricant supply unit 6 may make it difficult to control the quantity of the lubricant supplied to the transfer roller 2, in the lubricant supply unit 6. Here, the residual toner that has also passed through the lubricant supply unit 6 does not actively shift to the side of the intermediate transfer belt 401. In some cases, the residual toner may repeat circulating by entering the cleaning member 7 again.

Figure 5:
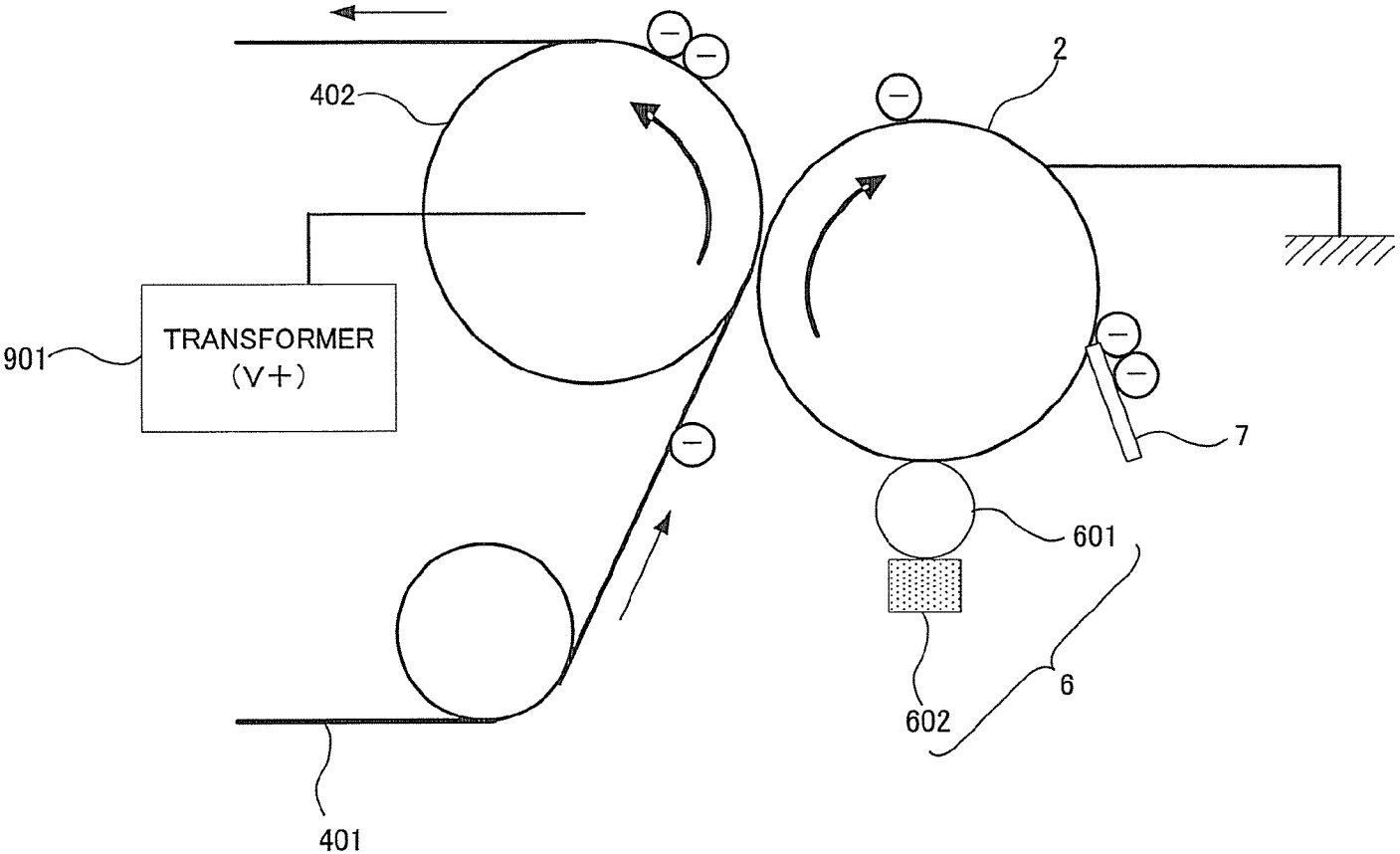
FIG. 5 is a view showing the state of electric field control by an electric field control unit 102.

FIG. 5 is a view showing the state of electric field control by the electric field control unit 102. In FIG. 5, as in the description with reference to FIG. 4, it is assumed that a toner charged with the transfer polarity, that is, a negatively charged toner, is adhering onto the transfer roller 2.

When a sheet jam occurs and the sheet does not reach the predetermined transfer position in the predetermined transfer timing, a large amount of toner shifts onto the transfer roller 2. However, as the information acquiring unit 101 detects information indicating the occurrence of the sheet jam (reaching failure information), the electric field control unit 102 changes the electric field generated between the transfer roller 2 and the intermediate transfer belt 401 to the opposite state to the electric field generated at the time of transferring the toner image on the intermediate transfer belt 401 to the sheet.

In the example shown in FIG. 5, a positive bias is applied to the side of a roller 402 on which the intermediate transfer belt 401 is wound, and active shift of the toner to the transfer roller 2 can be thus restrained. As shown in FIG. 5, the amount of the toner existing on the side of the intermediate transfer belt 401 is greater than the amount of the toner existing on the transfer roller 2.

With such a configuration, the quantity of the toner that reaches the cleaning member 7 can be restrained and cleaning of the roller surface of the transfer roller 2 by the cleaning member 7 can satisfactorily proceed. Consequently, the toner that the cleaning member 7 has failed to remove can be prevented from being supplied to the brush part that scrapes the solid lubricant 602 in the lubricant supply unit 6, and the state where the quantity of lubricant supply can be controlled is maintained.

Figure 6:
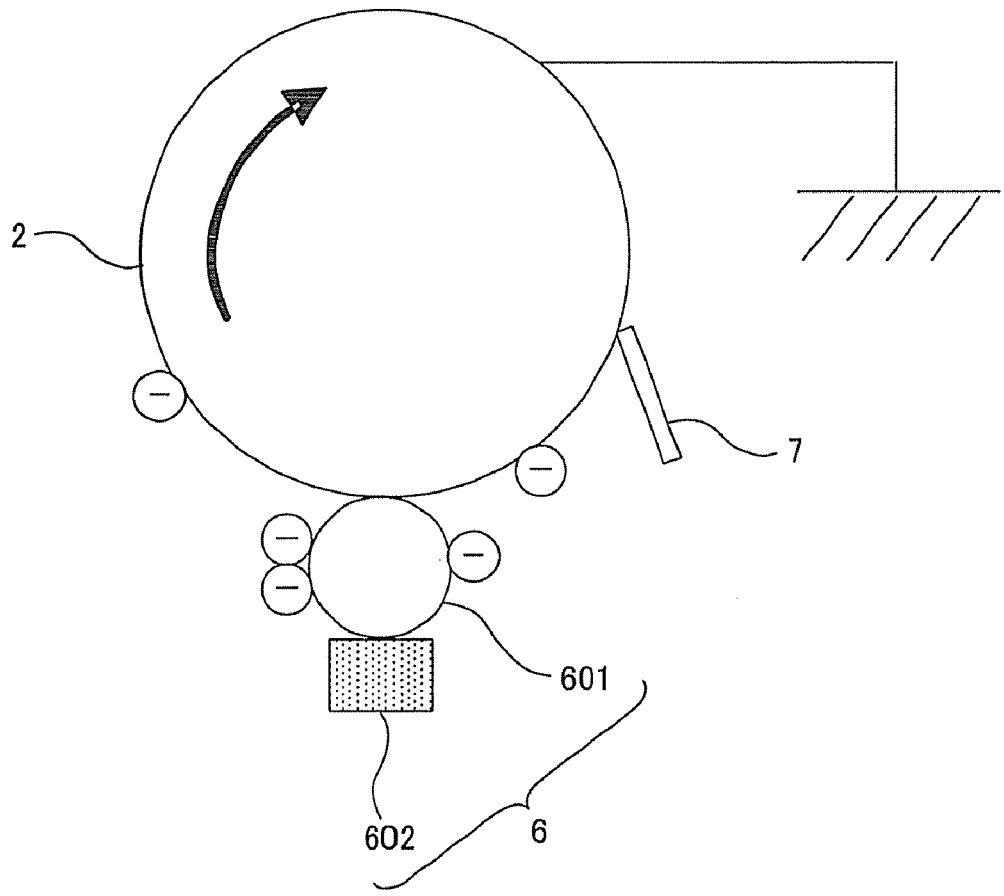
FIG. 6 is an explanatory view of a circumstance that takes place at the time of sheet jamming, in the case where a voltage to be applied to a lubricant supply unit 6 is not controlled.
Figure 7:
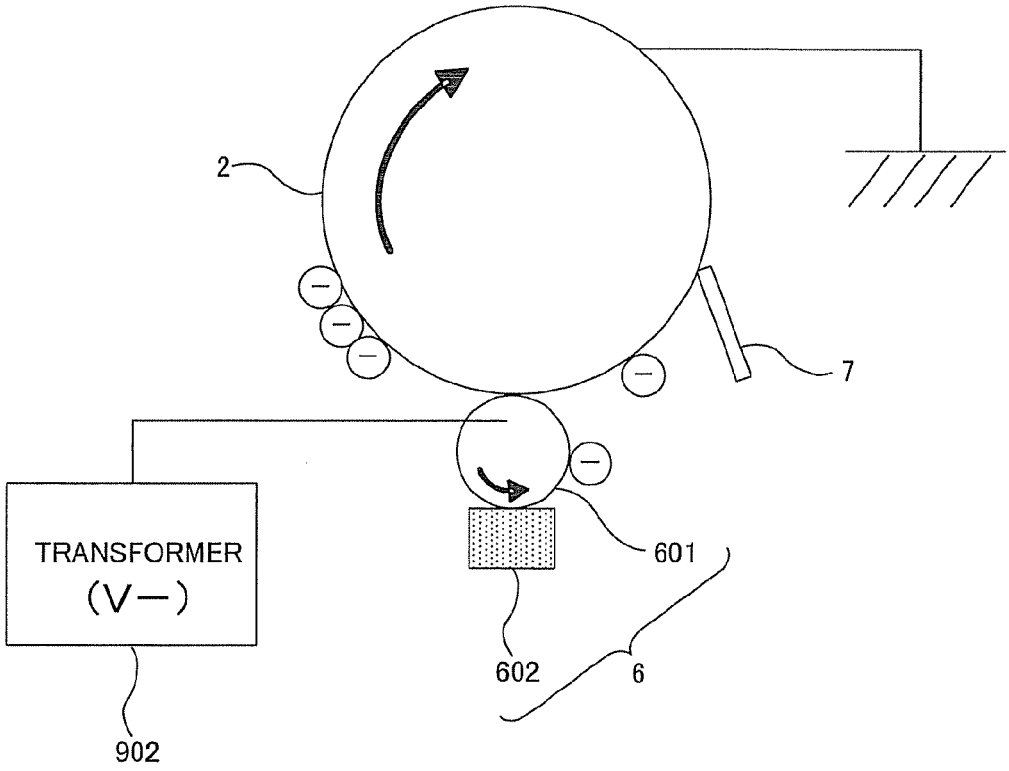
FIG. 7 is a view for explaining sheet jamming in the case where a transformer 902 is controlled by the electric field control unit 102 and a bias voltage is applied to the lubricant supply unit 6.

FIG. 6 is an explanatory view of a circumstance that takes place at the time of sheet jamming, in the case where the voltage applied to the lubricant supply unit 6 is not controlled. FIG. 6 and FIG. 7 only show the structure of the vicinity of the transfer roller, as a matter of convenience.

As in the description with reference to FIG. 4 and FIG. 5, a case is described where the residual toner adhering to the transfer roller 2 is charged with the transfer polarity, that is, negatively charged. The toner that the cleaning member 7 has failed to remove is supplied to the lubricant supply unit 6 abutted to the downstream side from the cleaning member 7 in the moving direction of the roller surface of the transfer roller 2.

The lubricant supply unit 6 in this embodiment has the lubricant application brush roller 601. The solid lubricant 602 is scraped by the lubricant application brush roller 601 into micro particles. The lubricant in the form of micro particles secured on the lubricant application brush roller 601 is applied to the roller surface of the transfer roller. However, as the toner exists between them, the scraping state and the quantity of secured lubricant micro particles may change. In this manner, if the toner that the cleaning member 7 has failed to remove is mixed with the lubricant in the form of micro particles secured on the lubricant application brush roller 601, the lubricant supply unit 6 falls into a state where the quantity of lubricant supply cannot be accurately controlled.

FIG. 7 is a view for explaining sheet jamming in the state where the transformer 902 is controlled by the electric field control unit 102 and a bias voltage is applied to the lubricant supply unit 6.

FIG. 7 shows a state where a toner charged with the transfer polarity, that is, a negatively charged toner, is adhering to the transfer roller 2, as in the configuration described with reference to FIG. 4 to FIG. 6. As in the configuration described with reference to FIG. 4, an effect is achieved that the toner that has already been drawn onto the lubricant application brush roller 601 is returned toward the transfer roller 2 without actively drawing the toner toward the lubricant application brush roller 601. By thus properly controlling the bias voltage applied to the lubricant supply unit 6 using the transformer 902 by the electric field control unit 102, as shown in FIG. 7, it is possible to avoid the problem that would occur in the state of FIG. 6, even if the toner slips by the cleaning member 7.

Figure 8:
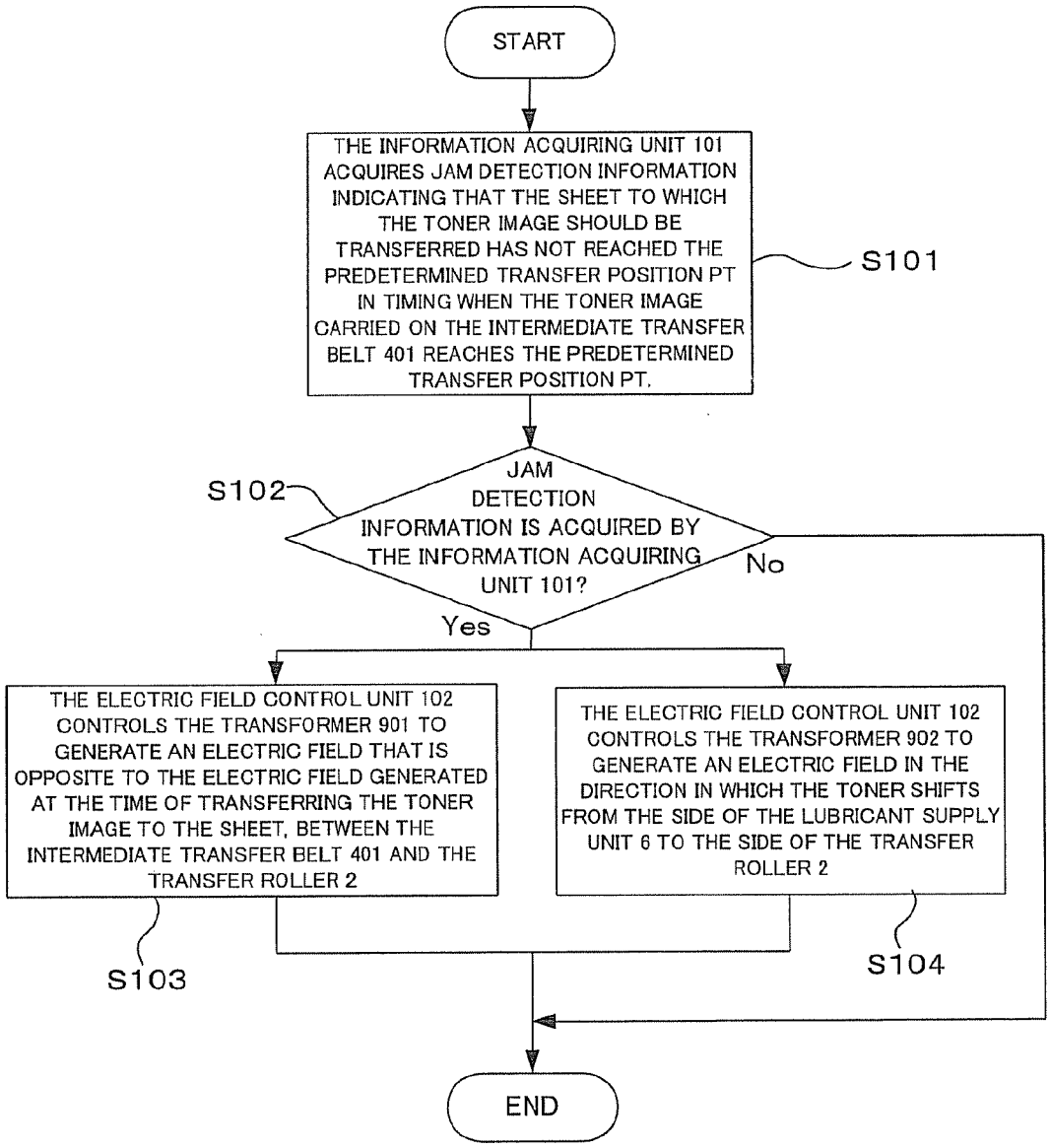
FIG. 8 is a flowchart for explaining a flow of processing (image quality maintaining method) in the image forming apparatus according to the embodiment.

FIG. 8 is a flowchart for explaining a flow of processing (image quality maintaining method) in the image forming apparatus according to the embodiment.

First, the information acquiring unit 101 acquires jam detection information (reaching failure information) indicating that the sheet to which the toner image should be transferred has not reached the predetermined transfer position PT (that is, a sheet jam has occurred) in timing when the toner image carried on the intermediate transfer belt 401 (image carrier) reaches the predetermined transfer position PT (S101).

In the case where jam detection information is acquired by the information acquiring unit 101 (Yes in S102), the electric field control unit 102 controls the transformer 901 to generate an electric field that is opposite to the electric field generated at the time of transferring the toner image to the sheet, between the intermediate transfer belt 401 and the transfer roller 2 (S103).

In addition to the above step (S103), in the case where jam detection information is acquired by the information acquiring unit 101 (Yes in S102), the electric field control unit 102 controls the transformer 902 to generate an electric field in the direction in which the toner shifts from the side of the lubricant supply unit 6 to the side of the transfer roller 2 (S104).

In the above embodiment, the case is described where the intermediate transfer roller 401 is used as an image carrier. However, the image carrier is not limited to this. As a matter of course, a photo conductive member in a direct transfer system, an intermediate transfer roller to which a toner image is transferred from the photo conductive member, and the like may also be used as an image carrier.

In the above embodiment, the configuration is described in which the intermediate transfer belt 401 and the transfer roller 2 cooperate to nip and carry a sheet. However, the configuration for nipping and carrying is not limited to this. For example, a configuration may be employed in which the intermediate transfer belt 401 and a transfer belt or the like as a transfer member cooperate to nip and carry a sheet and in which the cleaning member and the lubricant supply unit are abutted to the belt surface of the transfer belt.

As described above, according to the embodiment of the invention, even in the configuration in which the position where the lubricant is supplied is arranged downstream from the cleaning member, the quantity of lubricant supply can be controlled to an appropriate quantity and deterioration in the image quality due to residual toner can be restrained.

Each step in the processing in the above image forming apparatus is realized as the CPU 801 executes an image quality maintaining program stored in the memory 802.

In the embodiment, the case is described where the functions to carry out the invention have already been recorded in the apparatus. However, the form of the functions is not limited to this. Similar functions may be downloaded to the apparatus from a network. Alternatively, similar functions stored in a recording medium may be installed into the apparatus. As the recording medium, any form of recording medium that can store programs and can be read by the apparatus may be employed, such as CD-ROM. The functions thus acquired in advance by being installed or downloaded may be realized in cooperation with the operating system (OS) within the apparatus.

While the specific embodiment of the invention has been described in detail, it will be obvious to those skilled in the art that various changes and modifications can be made without departing from the scope and spirit of the invention.

As described above in detail, according to the invention, a technique can be provided that enables maintaining a proper level of image quality even under conditions that the quantity of residual toner increases in an image forming apparatus in which a lubricant is supplied to a cleaning target part from which a residual toner is removed by a cleaning member.

What is claimed is:

1. An image forming apparatus comprising:

an image carrier that holds and carries a toner image;

a transfer member that nips and carries a sheet in cooperation with the image carrier at a predetermined transfer position and transfers the toner image carried on the image carrier onto the sheet;

a cleaning member that is abutted to a transfer surface of the transfer member, and removes the toner adhering to the transfer surface;

a lubricant supply unit arranged downstream from the cleaning member and upstream from the predetermined transfer position in a moving direction of the transfer surface of the transfer member, and configured to supply a lubricant to the transfer surface of the transfer member;

an information acquiring unit configured to acquire reaching failure information indicating that the sheet to which the toner image should be transferred does not reach the predetermined transfer position in timing when the toner image carried on the image carrier reaches the predetermined transfer position; and an electric field control unit configured to generate an electric field that is opposite to an electric field generated when transferring the toner image on the image carrier to the sheet, between the image carrier and the transfer member in the case where the reaching failure information is acquired by the information acquiring unit, wherein in the case where the reaching failure information is acquired by the information acquiring unit, the electric field control unit generates an electric field in a direction in which the toner shifts from the side of the lubricant supply unit toward the image carrier wherein a voltage having same polarity of charged toner is applied to the lubricant supply unit by the electric field control unit.

2. The image forming apparatus according to claim 1, wherein the cleaning member is abutted to the transfer surface at an angle tilted toward the moving direction of the transfer surface with respect to a normal line on the transfer surface of the transfer member.

3. The image forming apparatus according to claim 1, wherein the information acquiring unit acquires information indicating that the sheet to which the toner image should be transferred is jammed, in timing when the toner image carried on the image carrier reaches the predetermined transfer position.

4. The image forming apparatus according to claim 1, wherein the image carrier is at least one of a photo conductive member, an intermediate transfer roller to which a toner image is transferred from the photo conductive member, and an intermediate transfer belt to which a toner image is transferred from the photo conductive member.

5. An image forming apparatus comprising:

an image carrier that holds and carries a toner image;

a transfer member that nips and carries a sheet in cooperation with the image carrier at a predetermined transfer position and transfers the toner image carried on the image carrier onto the sheet;

a cleaning member that is abutted to a transfer surface of the transfer member, and removes the toner adhering to the transfer surface;

a lubricant supply unit arranged downstream from the cleaning member and upstream from the predetermined transfer position in a moving direction of the transfer surface of the transfer member, and configured to supply a lubricant to the transfer surface of the transfer member;

an information acquiring unit configured to acquire reaching failure information indicating that the sheet to which the toner image should be transferred does not reach the predetermined transfer position in timing when the toner image carried on the image carrier reaches the predetermined transfer position; and an electric field control unit configured to generate an electric field in a direction in which the toner shifts from the side of the lubricant supply unit to toward the image carrier, in the case where the reaching failure information is acquired by the information acquiring unit, wherein a voltage having same polarity of charged toner is applied to the lubricant supply unit by the electric field control unit.

6. The image forming apparatus according to claim 5, wherein the cleaning member is abutted to the transfer surface at an angle tilted toward the moving direction of the transfer surface with respect to a normal line on the transfer surface of the transfer member.

7. The image forming apparatus according to claim 5, wherein the information acquiring unit acquires information indicating that the sheet to which the toner image should be transferred is jammed, in timing when the toner image carried on the image carrier reaches the predetermined transfer position.

8. The image forming apparatus according to claim 5, wherein the image carrier is at least one of a photo conductive member, an intermediate transfer roller to which a toner image is transferred from the photo conductive member, and an intermediate transfer belt to which a toner image is transferred from the photo conductive member.

9. An image quality maintaining method for an image forming apparatus including an image carrier that holds and carries a toner image, a transfer member that nips and carries a sheet in cooperation with the image carrier at a predetermined transfer position and transfers the toner image carried on the image carrier onto the sheet, a cleaning member that is abutted to a transfer surface of the transfer member, and removes the toner adhering to the transfer surface, and a lubricant supply unit arranged downstream from the cleaning member and upstream from the predetermined transfer position in a moving direction of the transfer surface of the transfer member and configured to supply a lubricant to the transfer surface of the transfer member, the method comprising:

acquiring reaching failure information indicating that the sheet to which the toner image should be transferred does not reach the predetermined transfer position in timing when the toner image carried on the image carrier reaches the predetermined transfer position;

generating an electric field that is opposite to an electric field generated when transferring the toner image on the image carrier to the sheet, between the image carrier and the transfer member in the case where the reaching failure information is acquired, wherein in the case where the reaching failure information is acquired, generating an electric field in a direction in which the toner shifts from the side of the lubricant supply unit toward the image carrier; and applying a voltage having same polarity as charged toner to the lubricant supply unit by an electric field control unit.

10. The image quality maintaining method according to claim 9, wherein the cleaning member is abutted to the transfer surface at an angle tilted toward the moving direction of the transfer surface with respect to a normal line on the transfer surface of the transfer member.

11. The image quality maintaining method according to claim 9, wherein information indicating that the sheet to which the toner image should be transferred is jammed is acquired as the reaching failure information in timing when the toner image carried on the image carrier reaches the predetermined transfer position.

12. The image quality maintaining method according to claim 9, wherein the image carrier is at least one of a photo conductive member, an intermediate transfer roller to which a toner image is transferred from the photo conductive member, and an intermediate transfer belt to which a toner image is transferred from the photo conductive member.

* * * * *